US010424244B2

(12) United States Patent
Le et al.

(10) Patent No.: US 10,424,244 B2
(45) Date of Patent: Sep. 24, 2019

(54) DISPLAY FLICKER REDUCTION SYSTEMS AND METHODS

(71) Applicant: Apple Inc., Cupertino, CA (US)

(72) Inventors: Chengrui Le, Cupertino, CA (US); Chaohao Wang, Sunnyvale, CA (US); Kingsuk Brahma, Mountain View, CA (US); Jie Won Ryu, Sunnyvale, CA (US); Chin-Wei Lin, Cupertino, CA (US); Rui Zhang, Santa Clara, CA (US)

(73) Assignee: Apple Inc., Cupertino, CA (US)

( * ) Notice: Subject to any disclaimer, the term of this patent is extended or adjusted under 35 U.S.C. 154(b) by 152 days.

(21) Appl. No.: 15/404,139

(22) Filed: Jan. 11, 2017

(65) Prior Publication Data

US 2018/0075801 A1 Mar. 15, 2018

Related U.S. Application Data

(60) Provisional application No. 62/385,817, filed on Sep. 9, 2016.

(51) Int. Cl.
*G09G 3/3233* (2016.01)

(52) U.S. Cl.
CPC ... *G09G 3/3233* (2013.01); *G09G 2300/0842* (2013.01); *G09G 2300/0861* (2013.01); *G09G 2310/0254* (2013.01); *G09G 2320/0247* (2013.01); *G09G 2320/0295* (2013.01); *G09G 2320/043* (2013.01); *G09G 2320/045* (2013.01); *G09G 2320/064* (2013.01); *G09G 2330/023* (2013.01); *G09G 2360/16* (2013.01)

(58) Field of Classification Search
CPC ..... G09G 3/3233; G09G 2300/0842; G09G 2300/0861; G09G 2310/0254; G09G 2320/0247; G09G 2320/0295; G09G 2320/043; G09G 2320/045; G09G 2320/064; G09G 2330/023; G09G 2360/16
See application file for complete search history.

(56) References Cited

U.S. PATENT DOCUMENTS 8,976,092 B2 * 3/2015 Hussain ..... G09G 5/10 345/102
2003/0020705 A1 * 1/2003 Kondo ..... G09G 3/3233 345/212

(Continued)

*Primary Examiner* — Stacy Khoo
(74) *Attorney, Agent, or Firm* — Kilpatrick Townsend & Stockton

(57) ABSTRACT

Aspects of the subject technology relate to electronic devices with displays. A display may include an array of display pixels each having a drive transistor and an organic light-emitting diode. A pulse-width-modulated current may be provided to the organic light-emitting diode during each display frame to compensate for an on-bias compensation applied to the drive transistor between display frames. The pulse-width-modulated current may be provided with a pulse-width-modulation ratio that decreases over the course of each display frame. The decrease of the pulse-width-modulation ratio for each display frame may be determined based on a peak luminance for that display frame. The reduction in flicker provided by the pulse-width-modulated current may facilitate operation of the display with a reduced refresh rate, thereby reducing power consumption by the display.

28 Claims, 14 Drawing Sheets

(56) References Cited

U.S. PATENT DOCUMENTS

| | | | | |
|---|---|---|---|---|
| 2008/0297452 | A1* | 12/2008 | Roush | G09G 3/3233 345/82 |
| 2010/0123651 | A1* | 5/2010 | Miller | G09G 3/3208 345/77 |
| 2010/0289424 | A1* | 11/2010 | Chang | H05B 33/0818 315/250 |
| 2012/0223958 | A1* | 9/2012 | Irie | G09G 3/2025 345/589 |
| 2014/0313241 | A1* | 10/2014 | Ono | G09G 3/3233 345/691 |
| 2014/0362062 | A1* | 12/2014 | Limketkai | G09G 3/3233 345/205 |
| 2016/0253964 | A1* | 9/2016 | Hwang | G09G 3/3233 345/214 |

* cited by examiner

HIGH PEAK LUM

LOWEST REFRESH RATE: 10Hz

LOW PEAK LUM

LOWEST REFRESH RATE: 1Hz

DISPLAY FLICKER REDUCTION SYSTEMS AND METHODS

CROSS-REFERENCE TO RELATED APPLICATIONS

The present application claims the benefit of priority under 35 U.S.C. § 119 as a non-provisional of U.S. Provisional Patent Application Ser. No. 62/385,817 entitled "Display Flicker Reduction Systems and Methods," and filed on Sep. 9, 2016, the disclosure of which is hereby incorporated by reference in its entirety for all purposes.

TECHNICAL FIELD

The present description relates generally to electronic devices with displays, and more particularly, but not exclusively, to electronic devices with reduced flicker and reduced power consumption.

BACKGROUND

Electronic devices such as computers, media players, cellular telephones, set-top boxes, and other electronic equipment are often provided with displays for displaying visual information. Displays such as organic light-emitting diode (OLED) displays and liquid crystal displays typically include an array of display pixels arranged in pixel rows and pixel columns. Display control circuitry coupled to the array of display pixels typically receives data for display from system control circuitry of the electronic device and, based on the data for display, generates and provides control signals to the array of display pixels. However, in some scenarios, various pixel-level effects that occur during operation of the pixel array can cause an undesirable visible flicker in displayed visual content.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

Figure 1:
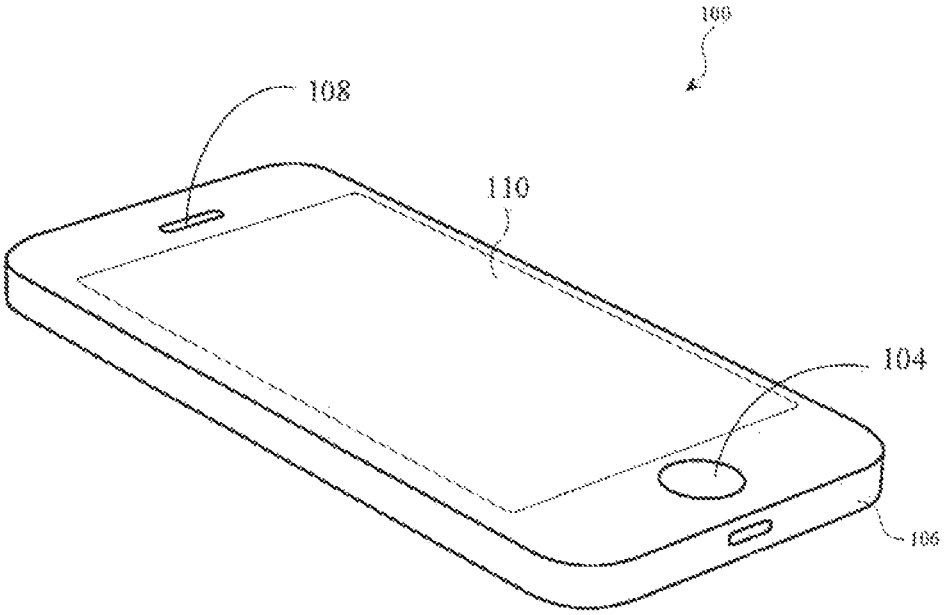
FIG. 1 illustrates a perspective view of an example electronic device implemented as a cellular telephone having a display in accordance with various aspects of the subject technology.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

The subject disclosure provides electronic devices such as cellular telephones, media players, computers, set-top boxes, wireless access points, and other electronic equipment that may include displays. Displays may be used to present visual information and status data and/or may be used to gather user input data. A display may include an array of display pixels. Each display pixel may include one or more colored subpixels for displaying color images.

For example, an electronic device may include a display having an array of display pixels. Each display pixel may include a pixel circuit having components such as thin-film transistors (TFTs) that are operable to control a light-emitting component such as an organic light-emitting diode (OLED).

In particular, a pixel circuit for an OLED display pixel may include a switching transistor operable to deliver a data voltage to the pixel and a drive transistor operable by the switching transistor to drive a current to the OLED. However, over the course of operating the drive transistor for one or more display frames, a stress hysteresis effect can occur in which the threshold voltage of the drive transistor varies between frames or within a frame.

The pixel circuit may be provided with additional circuitry and/or operational capability that compensates for this stress hysteresis effect. For example, a bias stress such as an on-bias stress or an off-bias stress can be applied to the drive transistor between each display frame to reset the threshold voltage. An applied on-bias stress can cause a brief threshold bias overshoot of the threshold voltage at the beginning of each display frame that can decay over the course of each display frame. An applied off-bias stress can cause a brief threshold bias undershoot of the threshold voltage at the beginning of each display frame that can decay over the course of each display frame. This overshoot or undershoot and resulting decay or ramping can, in some circumstances, cause a corresponding visible flicker in the brightness of the display.

In order to reduce or eliminate display brightness changes caused by an overshoot or undershoot and decay of the threshold voltage of the drive transistor, a pulse-width-modulated (PWM) current may be provided to the OLED of one or more pixels. The PWM current may be provided with a pulse width that decays at a rate which cancels out the threshold voltage decay. For an on-bias related overshoot and decay, the pulse width may be decreased over the course of a display frame. For an off-bias related overshoot and decay, the pulse width may be increased over the course of a display frame. In this way, the change in threshold voltage in the drive transistor can be compensated entirely or partially throughout each display frame. As described in further detail hereinafter, the pulse width decay or the bias stress can be dependent on the data to be displayed in a display frame that follows the bias stress compensation.

Flicker at a given level is more easily detectable by the human eye at a lower refresh rate. Accordingly, reducing the flicker using the PWM operations described herein may allow a display to be operated at a lower refresh rate than a conventional display. Operating a display at a lower refresh rate can reduce the power consumption of the display. Accordingly, in addition to providing the visual benefit of reduced flicker, the systems and methods disclosed herein may also help reduce power consumption for electronic devices, which can be particularly desirable for portable electronic devices with batteries.

In accordance with various aspects of the subject disclosure, each display pixel may include a pixel circuit having one or more transistors such as thin-film transistors (TFTs) operable to control operation of light emitting and/or light blocking elements of the pixel. For example, the transistors of the pixel circuit may include a switching transistor and a drive transistor operable to control an organic light emitting diode (OLED) of an OLED display pixel. Pulse width modulation of an input signal to the display pixel may be provided to compensate for a flicker effect caused by a compensation operation for bias stress in the drive transistor of the display pixel.

An illustrative electronic device of the type that may be provided with a display is shown in FIG. 1. In the example of FIG. 1, device 100 has been implemented using a housing that is sufficiently small to fit within a user's hand (e.g., device 100 of FIG. 1 may be a handheld electronic device such as a cellular telephone). As show in FIG. 1, device 100 may include a display such as display 110 mounted on the front of housing 106. Display 110 may be substantially filled with active display pixels or may have an active portion and an inactive portion. Display 110 may have openings (e.g., openings in the inactive or active portions of display 110) such as an opening to accommodate button 104 and an opening to accommodate speaker port 108.

Display 110 may be a touch screen that incorporates capacitive touch electrodes or other touch sensor components or may be a display that is not touch-sensitive. Display 110 may include display pixels formed from light-emitting diodes (LEDs), organic light-emitting diodes (OLEDs), plasma cells, electrophoretic display elements, electrowetting display elements, liquid crystal display (LCD) components, or other suitable display pixel structures. Arrangements in which display 110 is formed using organic light-emitting diode pixels are sometimes described herein as an example. This is, however, merely illustrative. In various implementations, any suitable type of display technology may be used in forming display 110, if desired.

Housing 106, which may sometimes be referred to as a case, may be formed of plastic, glass, ceramics, fiber composites, metal (e.g., stainless steel, aluminum, etc.), other suitable materials, or a combination of any two or more of these materials.

The configuration of electronic device 100 of FIG. 1 is merely illustrative. In other implementations, electronic device 100 may be a computer such as a computer that is integrated into a display such as a computer monitor, a laptop computer, a tablet computer, a somewhat smaller portable device such as a wrist-watch device, pendant device, or other wearable or miniature device, a media player, a gaming device, a navigation device, a computer monitor, a television, or other electronic equipment.

Figure 2:
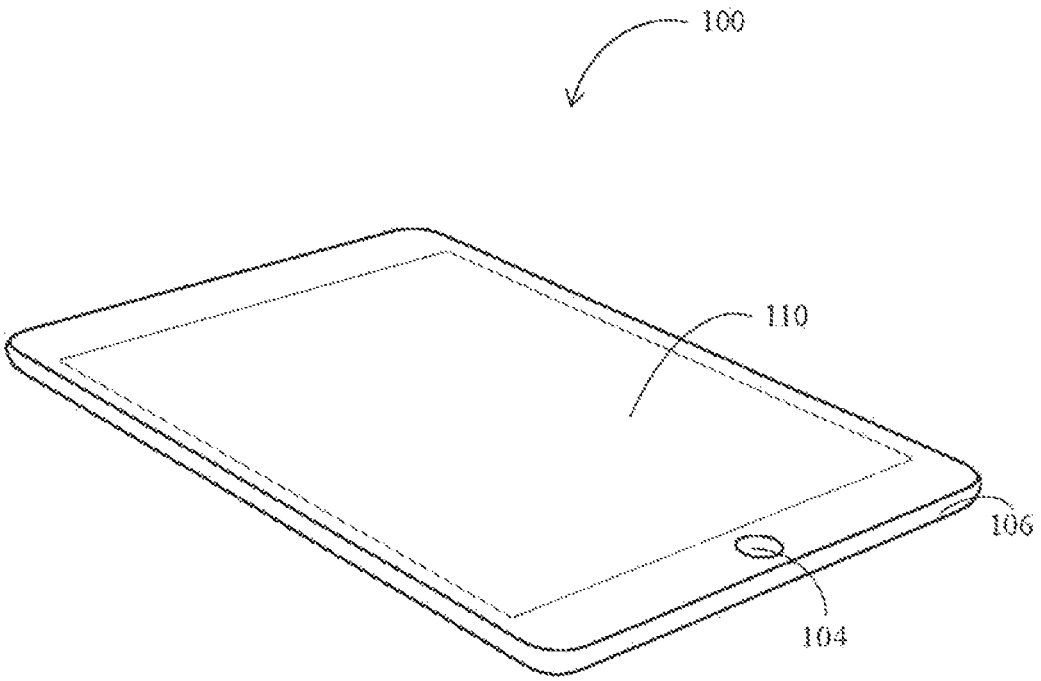
FIG. 2 illustrates a perspective view of an example electronic device implemented as a tablet computer having a display in accordance with various aspects of the subject technology.

For example, FIG. 2 is a perspective view of electronic device 100 in a configuration in which electronic device 100 has been implemented in the form of a tablet computer. As shown in FIG. 2, display 110 may be mounted on the upper (front) surface of housing 106. An opening may be formed in display 110 to accommodate button 104.

Figure 3:
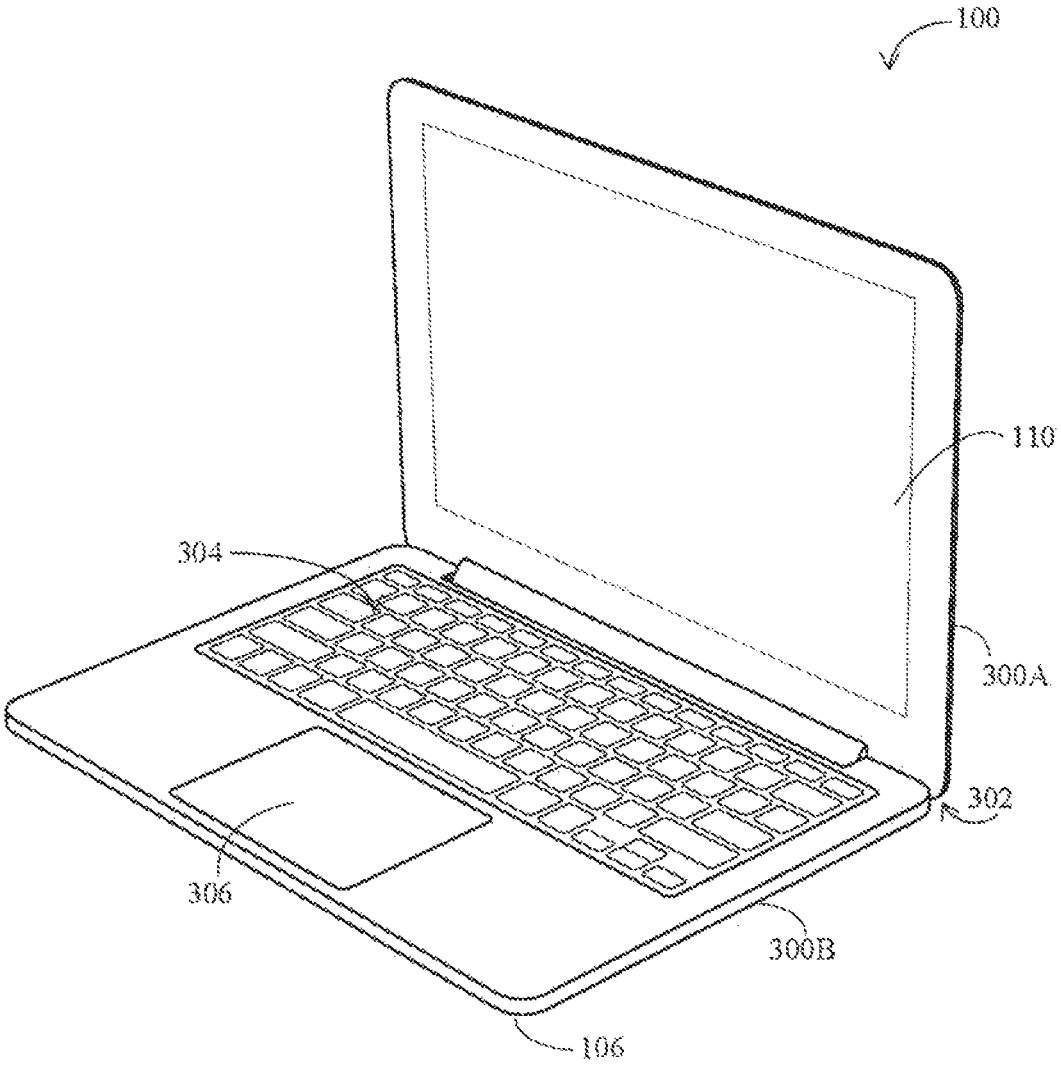
FIG. 3 illustrates a perspective view of an example electronic device implemented as a portable computer having a display in accordance with various aspects of the subject technology.

As another example, FIG. 3 is a perspective view of electronic device 100 in a configuration in which electronic device 100 has been implemented in the form of a portable computer. In the example of FIG. 3, housing 106 may be formed using a unibody configuration in which some or all of housing 106 is machined or molded as a single structure or may be formed using multiple structures (e.g., an internal frame structure, one or more structures that form exterior housing surfaces, etc.).

As shown in FIG. 3, housing 106 may have multiple parts. For example, housing 106 may have upper portion 300A and lower portion 300B. Upper portion 300A may be coupled to lower portion 300B using a hinge that allows portion 300A to rotate about rotational axis 302 relative to portion 300B.

A keyboard such as keyboard 304 and a touch pad such as touch pad 306 may be mounted in lower housing portion 302B, in some implementations.

Figure 4:
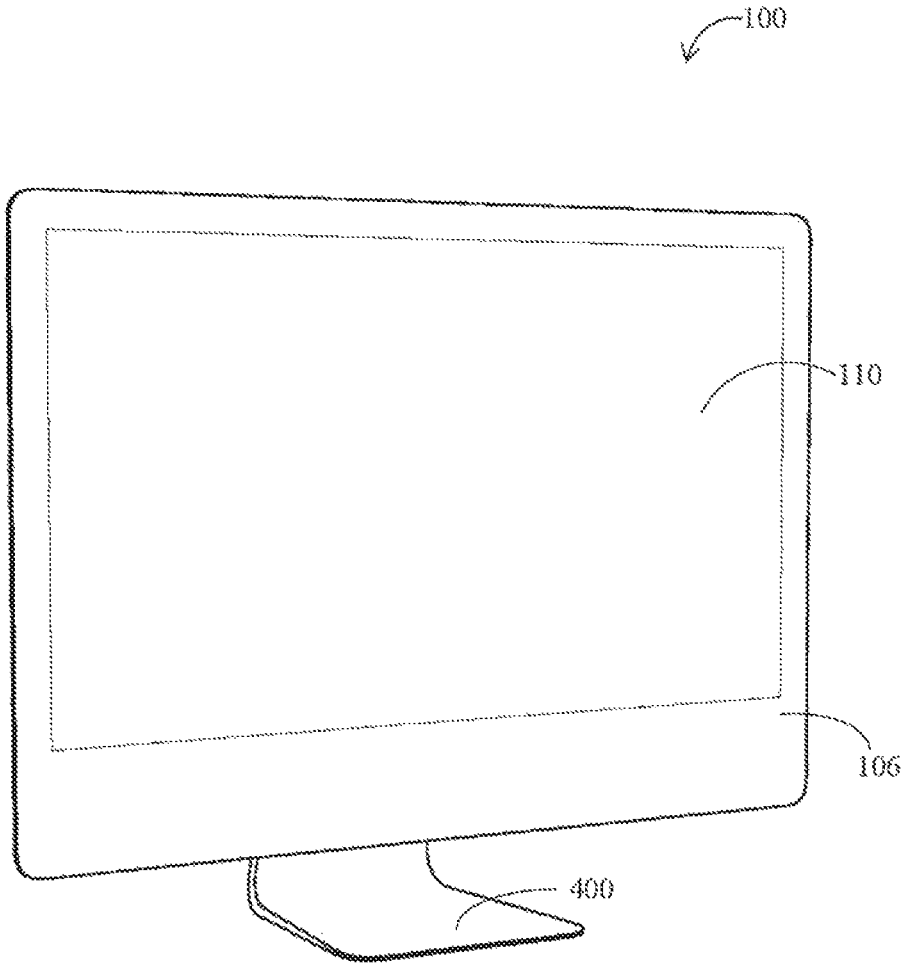
FIG. 4 illustrates a perspective view of an example electronic device implemented as a computer monitor with a built-in computer having a display in accordance with various aspects of the subject technology.

FIG. 4 is a perspective view of electronic device 100 in a configuration in which electronic device 100 has been implemented in the form of a computer integrated into a computer monitor. As shown in FIG. 4, display 110 may be mounted on a front surface of housing 106. Stand 400 may be used to support housing 106.

Figure 5:
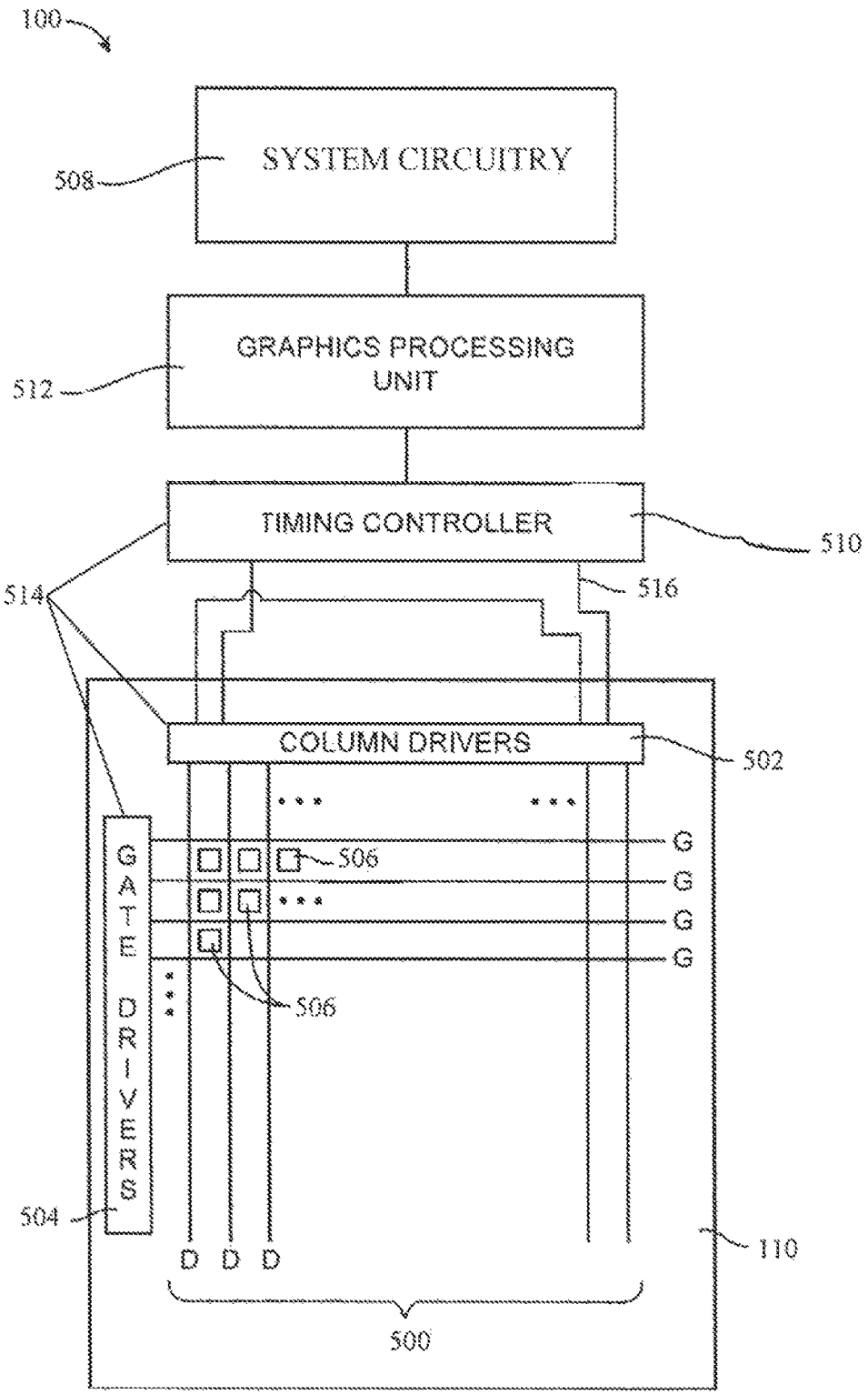
FIG. 5 illustrates a schematic diagram of an exemplary electronic device having a display in accordance with various aspects of the subject technology.

FIG. 5 is a schematic diagram of device 100 showing illustrative circuitry that may be used in displaying images for a user of device 100 on pixel array 500 of display 110. As shown in FIG. 5, display 110 may include column driver circuitry 502 that drives data signals (analog voltages) onto the data lines D of array 500. Gate driver circuitry 504 may drive gate line signals onto gate lines G of array 500.

Using the data lines D and gate lines G, display pixels 506 may be operated to display images on display 110 for a user. In some implementations, gate driver circuitry 504 may be implemented using thin-film transistor circuitry on a display substrate such as a glass or plastic display substrate or may be implemented using integrated circuits that are mounted on the display substrate or attached to the display substrate by a flexible printed circuit or other connecting layer. In some implementations, column driver circuitry 502 may be implemented using one or more column driver integrated circuits that are mounted on the display substrate or using column driver circuits mounted on other substrates.

Device 100 may include system circuitry 508. System circuitry 508 may include one or more different types of storage such as hard disk drive storage, nonvolatile memory (e.g., flash memory or other electrically-programmable-read-only memory), volatile memory (e.g., static or dynamic random-access-memory), magnetic or optical storage, permanent or removable storage and/or other non-transitory storage media configure to store static data, dynamic data, and/or computer readable instructions for processing circuitry in system circuitry 508. Processing circuitry in system circuitry 508 may be used in controlling the operation of device 100. Processing circuitry in system circuitry 508 may sometimes be referred to herein as system circuitry or a system-on-chip (SOC) for device 100.

The processing circuitry may be based on a processor such as a microprocessor and other suitable integrated circuits, multi-core processors, one or more application specific integrated circuits (ASICs) or field programmable gate arrays (FPGAs) that execute sequences of instructions or code, as examples. In one suitable arrangement, system circuitry 508 may be used to run software for device 100, such as internet browsing applications, email applications, media playback applications, operating system functions, software for capturing and processing images, software implementing functions associated with gathering and processing sensor data, software that makes adjustments to display brightness and touch sensor functionality, etc.

During operation of device 100, system circuitry 508 may produce data that is to be displayed on display 110. This display data may be provided to display control circuitry such as timing controller integrated circuit 510 using graphics processing unit 512.

Timing controller 510 may provide digital display data to column driver circuitry 502 using paths 516. Column driver circuitry 502 may receive the digital display data from timing controller 510. Using digital-to-analog converter circuitry within column driver circuitry 502, column driver circuitry 502 may provide corresponding analog output signals on the data lines D running along the columns of display pixels 506 of array 500.

Timing controller 510, column drivers 502, and gate drivers 504 may sometimes collectively be referred to herein as display control circuitry 514. Display control circuitry 514 may be used in controlling the operation of display 110. Display control circuitry 514 may be implemented, in some configurations, in a common package such as a display driver, a display controller, a display driver integrated circuit (IC), or a driver IC. Graphics processing unit 512 may perform image or other graphics processing on display data received from storage and processing circuitry 508 prior to providing the display data to display control circuitry 514 for display using pixels 506 of array 500. Graphics processing unit 512 may be a separate processing controller from system circuitry associated with storage and processing circuitry 508 or may be implemented as a part of storage and processing circuitry 508 (e.g., in a common SOC). Although a signal gate/scan line G and a single data line D for each pixel 506 are illustrated in FIG. 5, this is merely illustrative and one or more additional row-wise and/or column-wise control lines may be coupled to each pixel 506 in various implementations.

Figure 6:
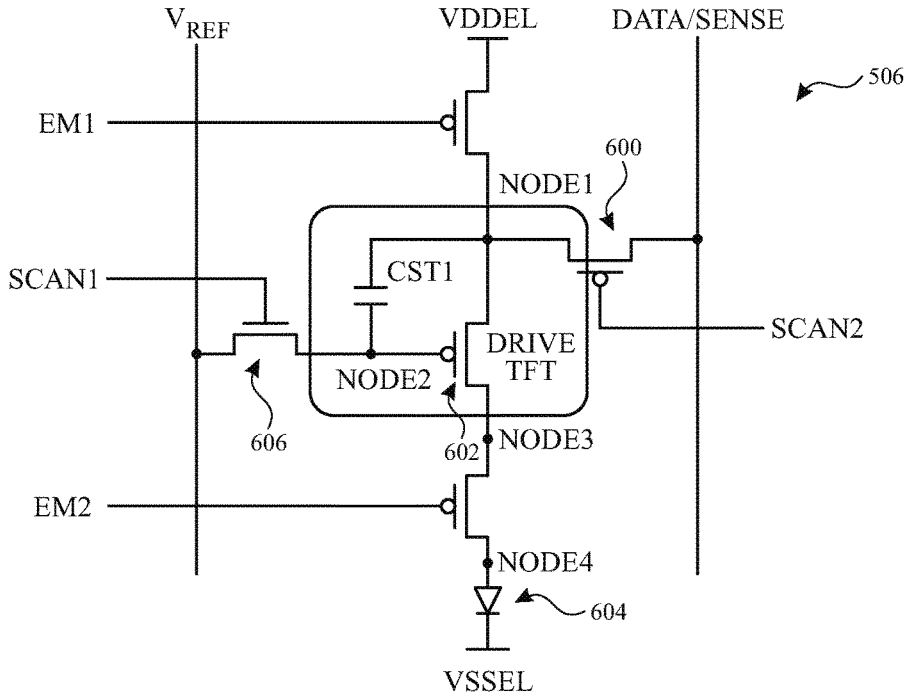
FIG. 6 illustrates a schematic diagram of an exemplary pixel circuit in accordance with various aspects of the subject technology.

One particular example of a pixel circuit for an OLED display pixel 506 is shown in FIG. 6. In the example of FIG. 6, pixel 506 is a five-transistor one-capacitor (5T1C) pixel circuit that includes a switching transistor 600 and a drive transistor 602 operable to control a current to a light-emitting element such as light-emitting diode 604 (e.g., an OLED). As shown in FIG. 6, switching transistor 600 may have a first terminal coupled to a data or drive line and a second terminal coupled to the gate of drive transistor 602. In the example of FIG. 6, the second terminal of switching transistor 600 is coupled to the gate of drive transistor 602 via a capacitor (Cst1). However, this is merely illustrative and other arrangements are contemplated.

The gate of switching transistor 600 may be coupled to a first scan or gate line. A scan or gate signal (Scan2) may be applied to the gate of switching transistor 600 from the first scan or gate line to allow a data signal to be applied to the gate of drive transistor 602 to allow a controlled current to be delivered to light-emitting element 604 (e.g., based on a positive supply voltage VDDEL and a negative supply voltage VSSEL) to control the luminance of, for example, the OLED.

In the example of FIG. 6, the pixel circuit includes an additional transistor 606 having a first terminal coupled to a reference voltage (Vref) and a second terminal coupled to the gate of the drive transistor. A second scan or gate line signal (Scan1) may be provided to operate additional transistor 606 to provide the reference voltage to the gate of drive transistor 602 (e.g., to provide an on-bias stress to drive transistor 602 to reset the threshold voltage of drive transistor 602 between each display frame). It should be appreciated that the arrangement of the pixel circuit shown in FIG. 6 is merely illustrative and other pixel circuits having a switching transistor, a drive transistor, an OLED and a mechanism for providing an on-bias stress compensation voltage to reset the threshold voltage of the drive transistor may be used in various implementations. For example, in some implementations, the on-bias stress (e.g., the on-bias stress compensation voltage) may be applied via switching transistor 600 by pulse-width modulating the data or drive line signal or the gate or Scan2 signal.

Figure 7:
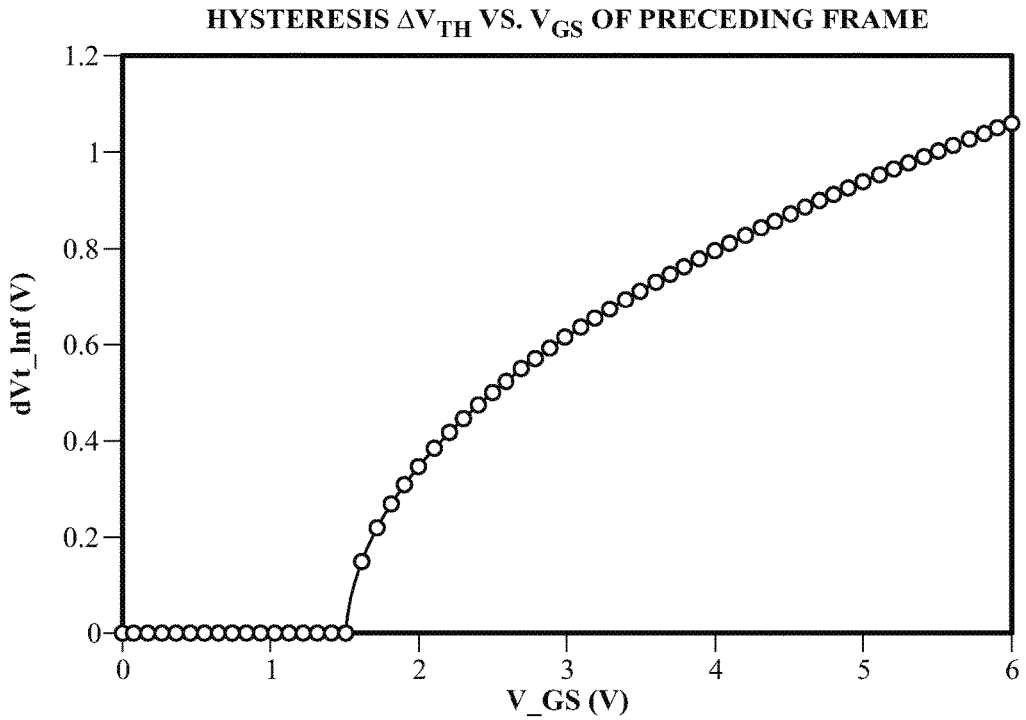
FIG. 7 illustrates a graph of a drive transistor threshold voltage hysteresis effect in accordance with various aspects of the subject technology.

FIG. 7 shows a graph of an illustrative change (dVt_inf) that can occur in the threshold voltage of drive transistor 602 for a current display frame as a function of the gate voltage V_gs applied during the preceding display frame. As shown in FIG. 7, the threshold voltage can exhibit a hysteresis effect in which the threshold voltage during the current frame depends on the operational history of the drive transistor. For example, when a carrier channel is created in a field-effect transistor such as a thin-film-transistor by applying a gate-source voltage, the threshold voltage of the transistor can change over time in what is sometimes referred to as a bias stress effect. As noted above, the pixel circuit of each pixel 506 may include circuitry for applying an on-bias stress to compensate for this bias stress effect.

Figure 8:
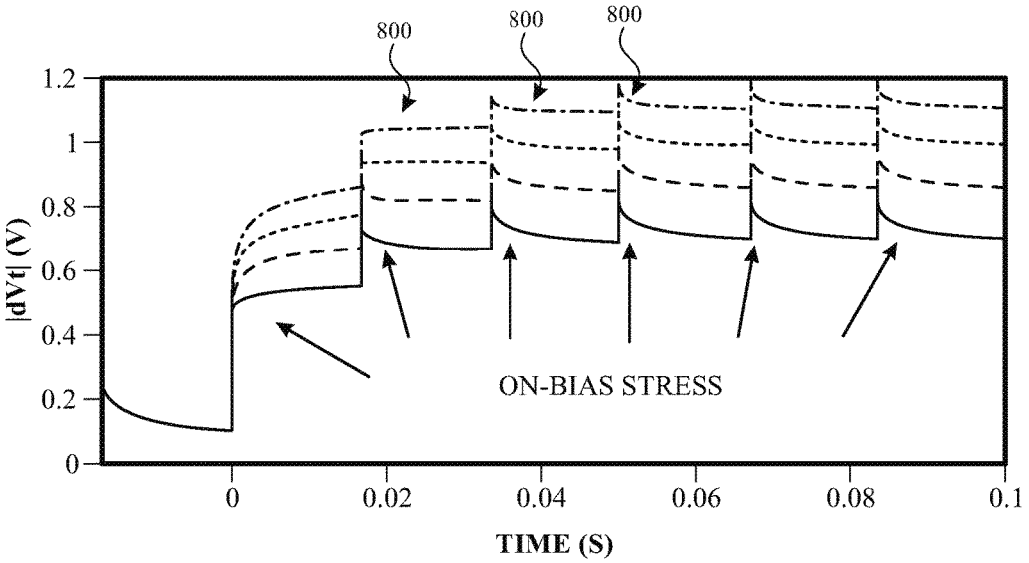
FIG. 8 illustrates a diagram of drive transistor threshold voltage changes during operation of a display pixel in accordance with various aspects of the subject technology.

However, as shown in FIG. 8, for each of a plurality of display frames 800 when the on-bias stress is applied at the beginning of each display frame, the threshold voltage can spike and then decay throughout the duration of the frame. The graph of FIG. 8 shows a change in the absolute value of the threshold voltage over time at four different voltage levels.

Figure 9:
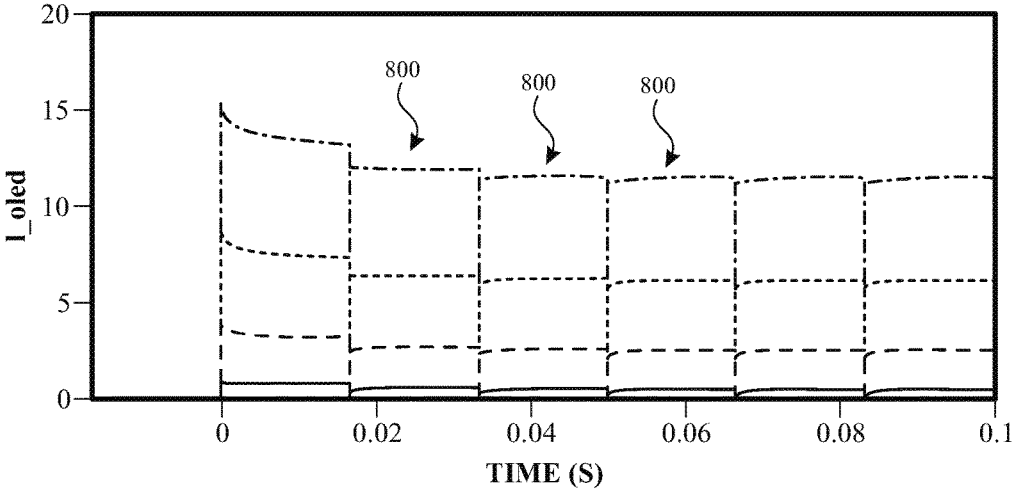
FIG. 9 illustrates a diagram of OLED brightness changes due to the drive transistor threshold voltage changes of FIG. 8 in accordance with various aspects of the subject technology.

FIG. 9 shows a graph of illustrative pixel luminance (I_oled) changes over the same time period as the time period of FIG. 8. As can be seen in FIG. 9, the luminance of the pixel can dip at the beginning of each frame and then rise over the course of the frame (e.g., during progression of the frame) due to the applied on-bias stress, which can cause a visible display flicker, particularly if a low refresh rate is used.

Figure 10:
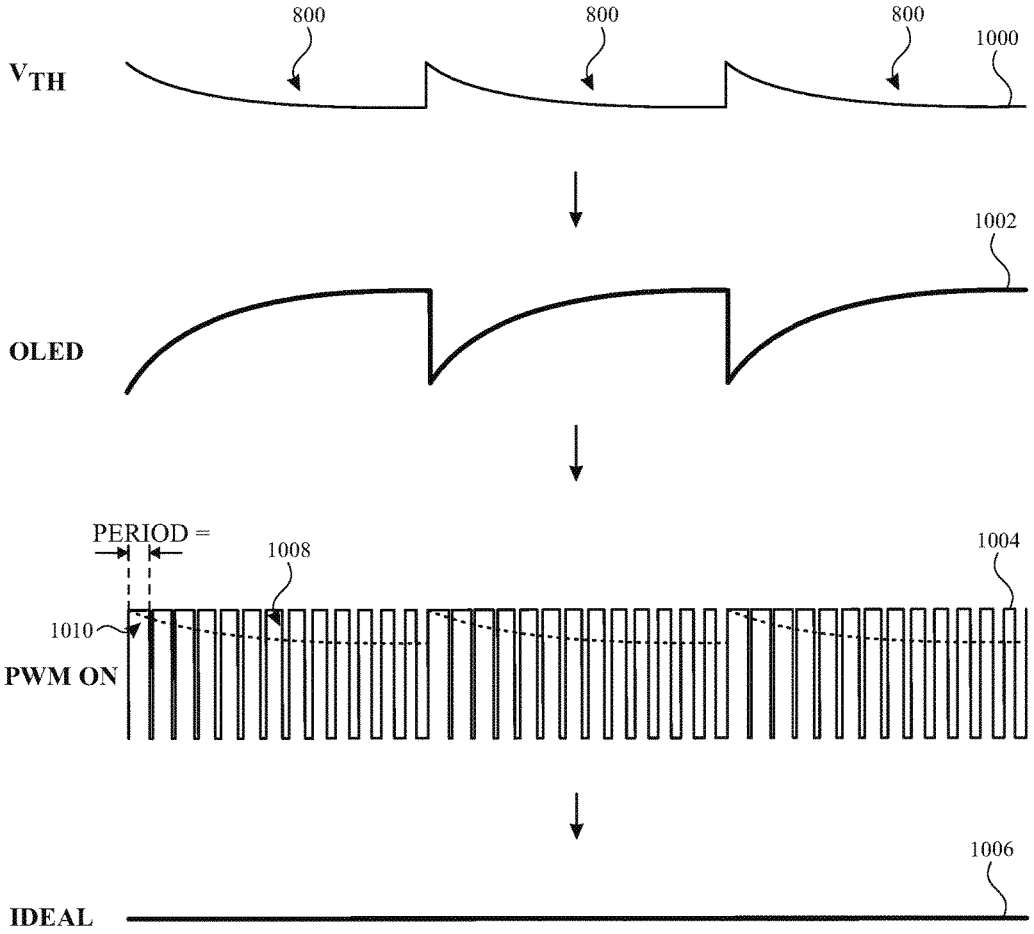
FIG. 10 illustrates a diagram of various pixel signal timelines during operation of a display pixel in accordance with various aspects of the subject technology.

FIG. 10 illustrates a threshold voltage ($V_{TH}$) timeline 1000 and a resulting OLED luminance timeline 1002 over the course of three display frames 800 when no correction for the on-bias stress is performed. However, FIG. 10 also illustrates a pulse-width modulated signal 1004 that may be applied to the pixel with an "on" pulse having a pulse width 1010 or period that decreases or decays over the course of each display frame 800 (as indicated by decay curves 1008). PWM signal 1004 may counteract the OLED luminance changes of timeline 1002 to produce a flat "Ideal" visible luminance 1006 on the display.

More particularly, because the "on" portion of signal 1004 decreases and the "off" portion of signal 1004 increases (e.g., the PWM ratio of the "on" width to the "off" width or of the "on" width to the total width of any particular portion of the frame time decreases) over the course of each display frame, the time-averaged value of PWM signal 1004 decreases over the course of each display frame according to decay curve 1008. PWM signal 1004 may represent the current provided to the OLED of a display pixel or may represent a control signal (e.g., an input voltage) that controls the provided current. Accordingly, the time averaged value of the current provided to the OLED of a display pixel may be reduced according to decay curve 1008 to compensate for the increase in luminance shown in timeline 1002.

Although the examples of FIGS. 8-10 describe a PWM compensation for an on-bias stress effect, the PWM compensation including a PWM ratio that decreases over the course of a display frame, it should be appreciated that, to compensate for an off-bias stress effect, PWM compensation including a PWM ratio that increases over the course of a display frame can be applied.

Decay curve 1008 may be controlled based on one or more PWM parameters. The PWM parameters may be determined, for example, during calibration operations performed during manufacturing of display 110 or device 100. The PWM parameters may be display-specific or device-specific parameters or may be common across a population of displays or devices. The PWM parameters may be parameters of a mathematical equation such as an exponential decay equation or may be parameters of a look-up table that specifies the PWM ratio for each of several portions of a display frame. One exemplary PWM parameter that may be used to characterize PWM decay curve 1008 is the minimum PWM ratio for a particular display frame. For example, the PWM ratio may be arranged to decay exponentially from a maximum of 1 (e.g., 100% on) to the determined minimum PWM ratio over the time of the current display frame. As another example, the PWM ratio may be arranged to increase in an increasing exponential decay from the determined minimum PWM ratio asymptotically to a maximum of 1 (e.g., 100% on) over the time of the current display frame.

PWM compensation for pixel-level on-bias stress effects, as described herein, may be provided on a pixel-by-pixel basis, may be commonly applied to a region of a display pixel array, or may be globally applied to all of pixels (e.g., the active pixels) of the pixel array. In configurations in which the PWM compensation is applied on a global or regional level, the minimum PWM ratio (or maximum PWM compensation) may be determined based on the peak luminance of the display (or the region of the display) for a current display frame. The peak luminance over the pixels of the display (or over a region thereof) may be the luminance of the brightest pixel in the array (or region) or may be an average or median or other aggregate luminance of a group of brightest pixels (e.g., the brightest 90% or brightest 95% of pixels) in the array (or region). For example, respective pulse-width-modulated currents may be provided to the organic light-emitting diodes of an array of display pixels by modulating a pixel-specific display current for each display pixel with a global pulse-width modulation. As another example, respective pulse-width-modulated currents may be provided to the organic light-emitting diodes of an array of display pixels by modulating a pixel-specific display current for each display pixel with a regional pulse-width modulation that is specific to a region of the array of display pixels (e.g., a quadrant or other region). As another example, respective pulse-width-modulated currents may be provided to the organic light-emitting diodes of an array of display pixels by modulating a pixel-specific display current for each display pixel with a pixel-specific pulse-width modulation.

Figure 11:
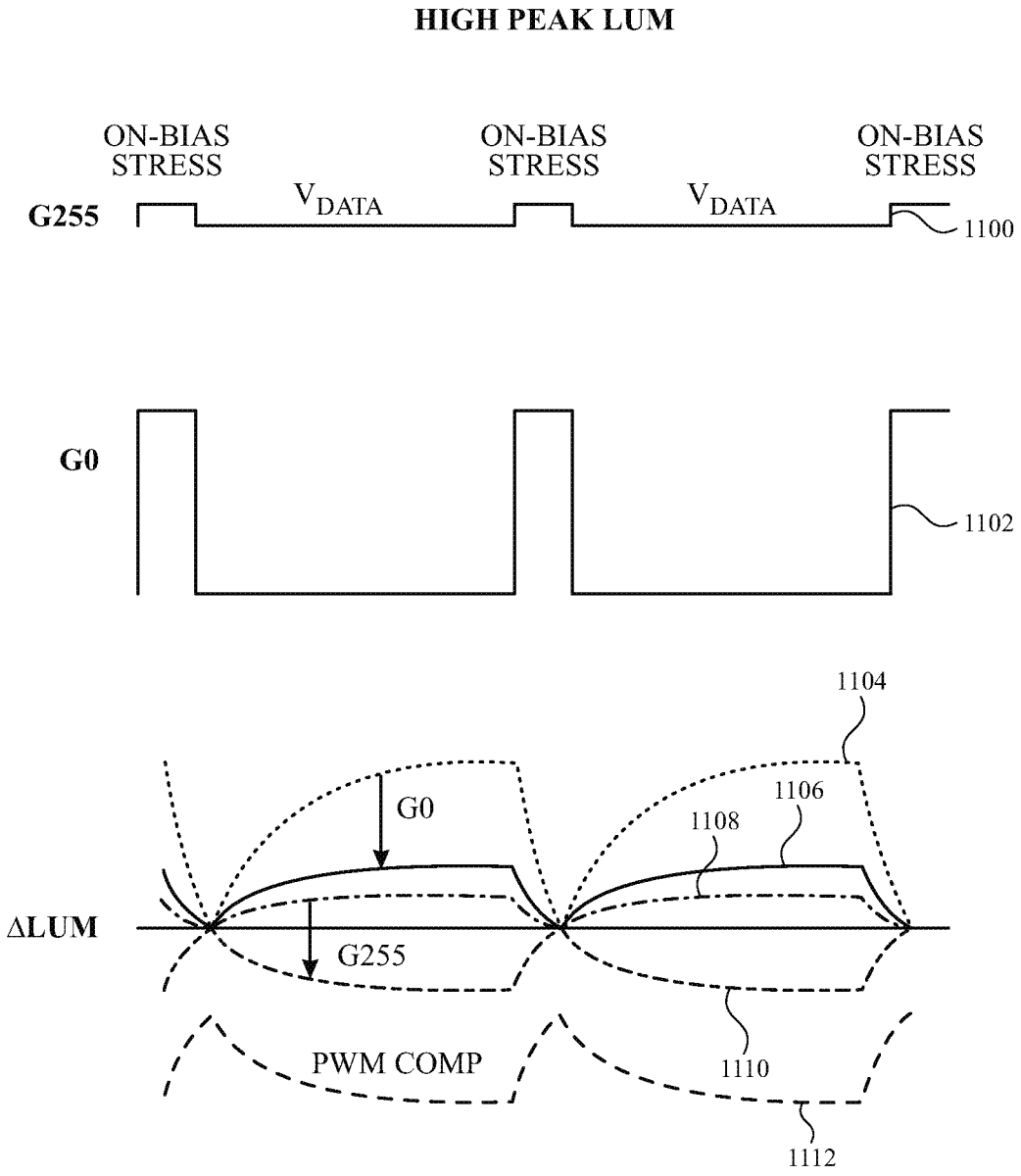
FIG. 11 illustrates a diagram of various pixel signal timelines for high peak luminance display frames during operation of a display pixel in accordance with various aspects of the subject technology.

FIG. 11 shows a signal voltage timeline 1100 for a brightest pixel (G255) of a display (or region thereof) and a signal voltage timeline 1102 for a faintest pixel (G0) of the display (or region thereof) for display frames having a high peak luminance (or high dynamic range across the array or region) and having on-bias compensation provided between each frame. As shown in FIG. 11, for a high peak luminance frame, the difference between the on-bias stress voltage and data voltage ($V_{Data}$) is relatively small for the G255 pixel and relatively large for the G0 pixel. Because the PWM compensation, in this example, is to be applied globally to both the G255 pixel and the G0 pixel (and one or more other pixels of the array or region), the maximum PWM compensation may be chosen to balance the compensation for the G255, G0, and/or other pixels (e.g., to avoid or balance overcompensating for the G255 luminance to compensate for the G0 luminance).

FIG. 11 also shows luminance timelines for the G255 and G0 pixels in the high-peak-luminance example. As shown, an uncorrected G0 luminance timeline 1104 may be corrected, based on a PWM compensation ratio timeline 1112, to a corrected G0 luminance timeline 1106 and uncorrected G255 luminance timeline 1108 may be corrected (e.g., overcorrected in this example), based on PWM compensation ratio timeline 1112, to a corrected G255 luminance timeline 1110.

Figure 12:
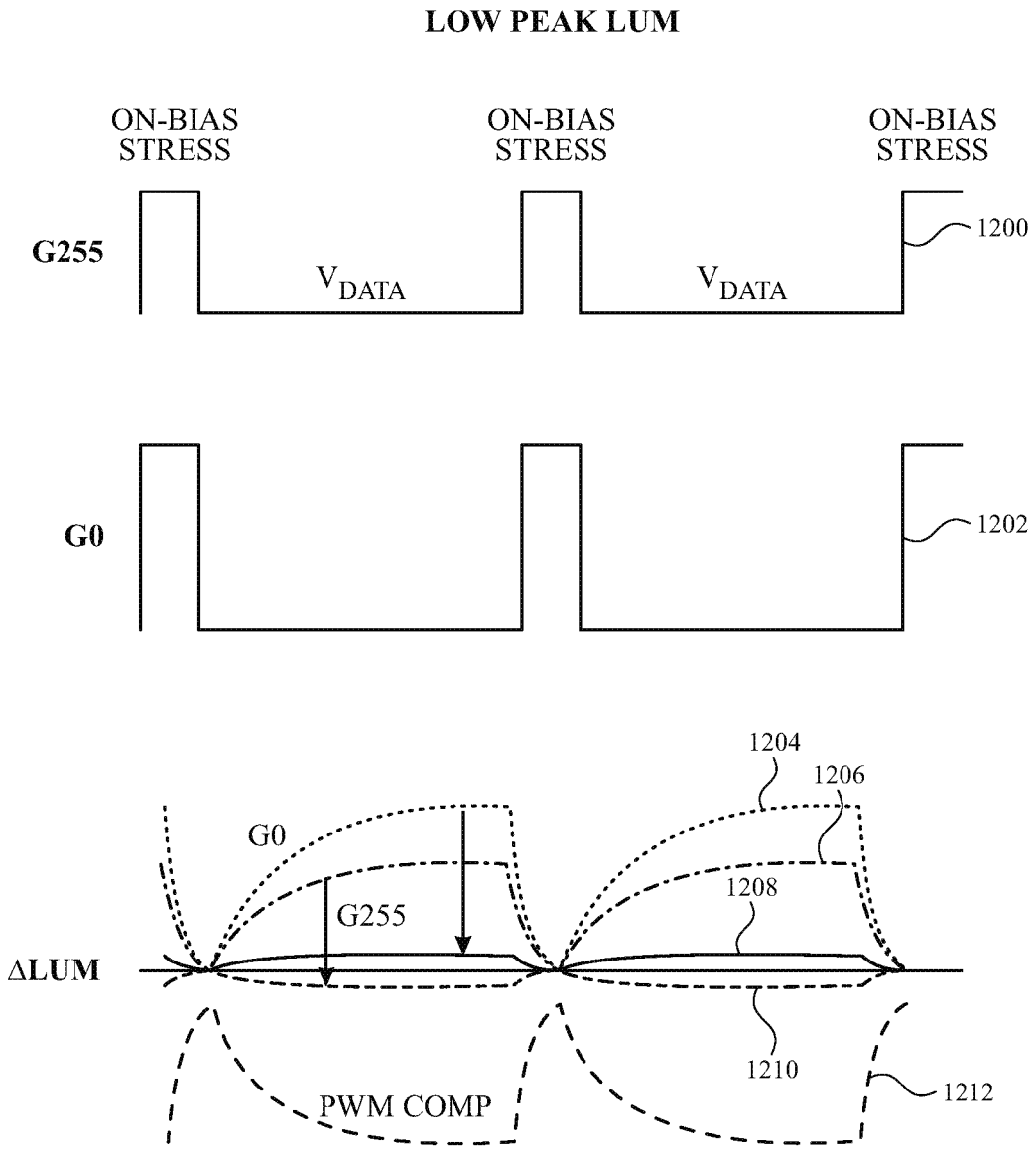
FIG. 12 illustrates a diagram of various pixel signal timelines for low peak luminance display frames during operation of a display pixel in accordance with various aspects of the subject technology.

FIG. 12 shows a signal voltage timeline 1200 for a brightest pixel (G255) of a display (or region thereof) and a signal voltage timeline 1202 for a faintest pixel (G0) of the display (or region thereof) for a display frames having a low peak luminance (or low dynamic range across the array or region) and having on-bias compensation provided between each frame. As shown in FIG. 12, for a low peak luminance display frame, the difference between the on-bias stress voltage and data voltage ($V_{Data}$) is relatively large for both the G255 pixel the G0 pixel. The desired compensation for the G255 and G0 pixels is therefore similar, in comparison with the high peak luminance example. Accordingly, a relatively more aggressive PWM compensation ratio timeline 1212 may be applied to correct the uncorrected G0 luminance timeline 1204 to a corrected G0 luminance timeline 1208 and to correct the uncorrected G255 luminance timeline 1206 to a corrected G255 luminance timeline 1210. As shown in FIGS. 11 and 12, the PWM compensation for a low peak luminance (low dynamic range) display frame may be larger than the PWM compensation for a high peak luminance (high dynamic range) display frame.

Figure 13:
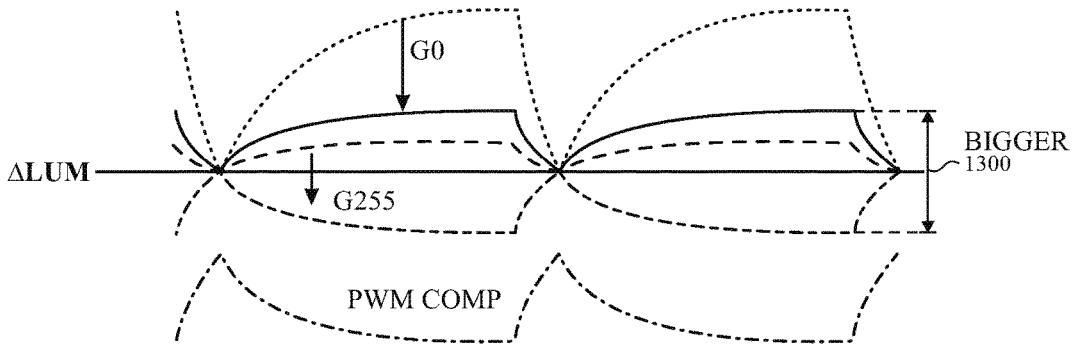
FIG. 13 illustrates a diagram of residual flicker for high peak luminance display frames during operation of a display pixel in accordance with various aspects of the subject technology.
Figure 14:
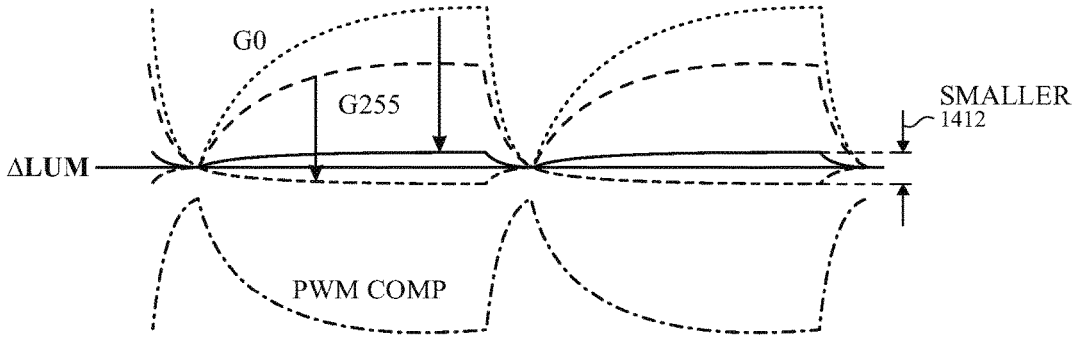
FIG. 14 illustrates a diagram of residual flicker for low peak luminance display frames during operation of a display pixel in accordance with various aspects of the subject technology.

FIGS. 13 and 14 reproduce timelines 1104, 1106, 1108, and 1110 and 1204, 1206, 1208, and 1210 of FIGS. 11 and 12, respectively and illustrate a residual flicker 1300 in the high peak luminance example that is bigger than a smaller residual flicker 1412 in the low peak luminance example. In some implementations, the lowest available refresh rate for a display may be determined to be the refresh rate below which flicker becomes visible. The reduced flicker provided by the PWM modulation operations described herein can facilitate operation of a display with a correspondingly lowered minimum available refresh rate. In this way, power consumption by the display can also be reduced.

In the high peak luminance example of FIG. 13, residual flicker 1300 may result in a "lowest" or minimum available refresh rate of 10 Hz (for example). In the low peak luminance example of FIG. 14, residual flicker 1412 may result in a "lowest" or minimum available refresh rate of 1 Hz (for example). Accordingly, the minimum available refresh rate for a particular display frame may be determined based on the peak luminance of that frame (e.g., because the PWM compensation, and therefore the residual flicker, depends on the peak luminance).

The minimum available refresh rate provided by the PWM compensation operations described herein may be a lower limit for a dynamic refresh rate operation for display 110. For example, display control circuitry 514 may dynamically control the refresh rate of the display based on the content being displayed in some implementations. For example, static content (e.g., a page of an electronic book or a still image) can be displayed with a refresh rate that is lower than the refresh rate for dynamic content (e.g., video content). However, the minimum refresh rate available for these dynamic refresh rate operations, even for static content, may be dependent on other factors such as a desire to prevent display flicker. Accordingly, when, for example, static content is displayed, a lower refresh rate may be used, in comparison with conventional displays, without inducing display flicker. In this way, additional power savings for the display device can be provided without compromising the user viewing experience.

The minimum available refresh rate may be calibrated (e.g., for each display, for each device, or for a population of displays or devices) during manufacturing and testing operations. In some implementations, a look-up table may be stored by display control circuitry 514 or system circuitry 508 that provides a minimum available refresh rate for each of several peak luminance ranges. An example of a look-up table for determining minimum available refresh rates from a luminance range of a display frame is shown below.

TABLE 1

| 0-10 nits | 0-50 nits | 0-100 nits | 0-500 nits | 0-750 nits |
|---|---|---|---|---|
| 1 Hz | 5 Hz | 10 Hz | 15 Hz | 24 Hz |

In the illustrative Table 1 above, minimum available refresh rates of 1 Hz, 5 Hz, 10 Hz, 15 Hz, and 24 Hz are provided for respective luminance ranges of 0-10 nits, 0-50 nits, 0-100 nits, 0-500 nits, and 0-750 nits. A refresh rate for each display frame may be determined from table of this type. However, it should be appreciated that the table above is merely illustrative and that a look-up table having more luminance range columns (e.g., for ranges of a finer granularity or for ranges that do not include 0 such as a 450-460 nits range), with associated minimum available refresh rates, may be provided.

In some implementations, PWM ratio decay curve 1008 (see FIG. 10) may also be calibrated to the peak luminance of a display frame. During operation of display 110, PWM ratio decay curve 1008 may be determined, for example, using a look-up table. For example, an exemplary look-up table may include PWM percentages for each of several peak luminances within each of several time intervals. For example, for a display frame having a peak luminance of 500 nits, in a first time interval (e.g., a first 4 millisecond time interval) a PWM ratio of 1 (corresponding to a PWM percentage of 100 percent) may be provided, changing to a PWM ratio of 0.999, 0.993, 0.991, 0.990, etc. for subsequent second, third, fourth, fifth, etc. time intervals (e.g., a second, third, fourth, fifth, etc. 4 millisecond time intervals) within a display frame. Similar sets of PWM ratios may be included, each set corresponding to a particular peak luminance and each ratio in the set corresponding to a particular time interval. Using a look-up table of this type, a decay curve for the pulse-width modulation may be determined based on a peak luminance across a plurality of display pixels (e.g., over all of the display pixels or a subset or region of the display pixels). A look-up table for determining PWM ratio decay curve 1008 may include, for example, a PWM ratio for each 4 millisecond time interval for each peak luminance or may include more or fewer entries (e.g., with display circuitry configured to interpolate between entries). PWM ratios in a look-up table may range from 0 to 1 with, for example, about a 10 bit resolution (for example). PWM ratios in a look-up table may be provided for time intervals up through a longest available display frame time, though, during operation, only PWM ratios for time intervals up to the end of the current display frame may be used. PWM percentages may also or alternatively be provided that correspond to PWM ratios (e.g., by dividing the percentages by 100) as would be understood by one of ordinary skill in the art. It should also be appreciated that determining PWM percentages or PWM ratios for each time interval of a display frame using a look-up table as described is merely illustrative. In other implementations, PWM percentages or PWM ratios may be determined based on a mathematical equation such as an exponential decay equation with equation parameters specific to the peak luminance of the current display frame.

Figure 15:
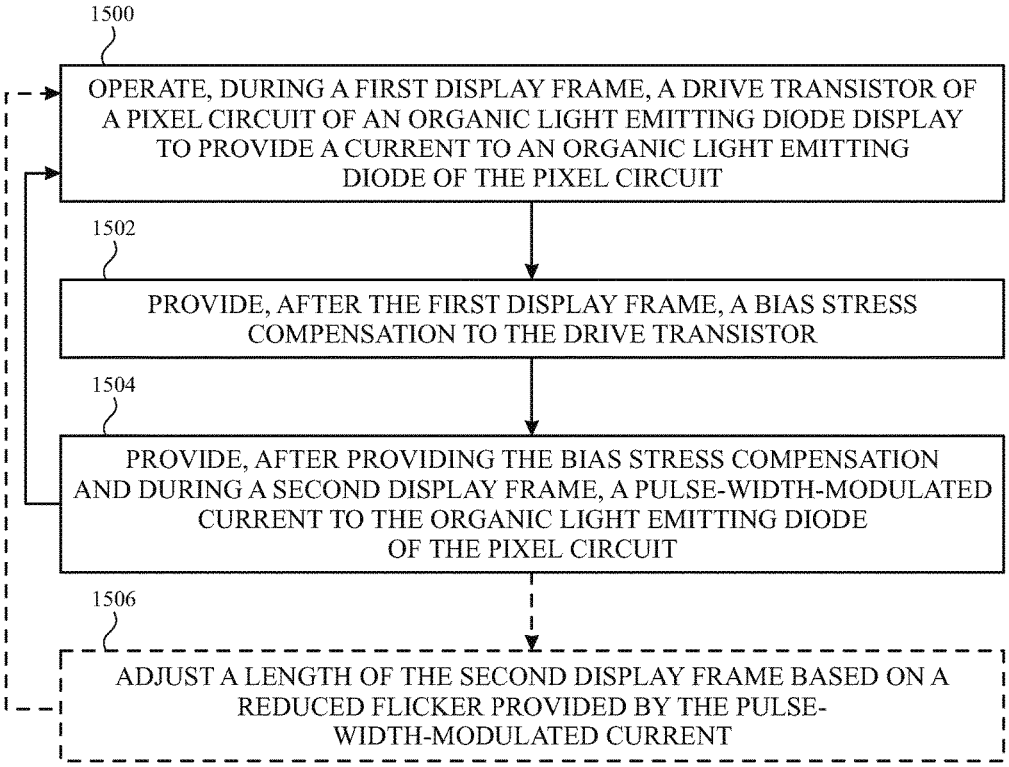
FIG. 15 illustrates a flow chart of an example process for pulse-width-modulated operation of an electronic device display in accordance with various aspects of the subject technology.

FIG. 15 depicts a flow diagram of an example process for PWM flicker reduction for electronic device displays in accordance with various aspects of the subject technology. For explanatory purposes, the example process of FIG. 15 is described herein with reference to the components of FIGS. 1-5. Further for explanatory purposes, the blocks of the example process of FIG. 15 are described herein as occurring in series, or linearly. However, multiple blocks of the example process of FIG. 15 may occur in parallel. In addition, the blocks of the example process of FIG. 15 need not be performed in the order shown and/or one or more of the blocks of the example process of FIG. 15 need not be performed.

In the depicted example flow diagram, at block 1500, a drive transistor such as drive transistor 602 of a pixel circuit of an organic light emitting diode display pixel may be operated to provide a current to an organic light emitting diode (OLED) such as OLED 604 of the pixel circuit for a first display frame. The current may be a display current that illuminates the OLED at a desired brightness. Providing the current to the OLED may generate light for displaying a pixel of visual information for the first display frame on the OLED display. More generally, an array of light-emitting diode display pixels may be operated (e.g., by operating the drive transistors thereof) to display visual information during a first display frame. Operating the drive transistor during the first frame may also cause a threshold voltage of the drive transistor to change due to a bias stress effect.

At block 1502, a bias stress compensation such as an on-bias stress compensation or an off-bias stress compensation may be provided to the drive transistor of the pixel circuit after the first display frame. Providing the bias stress compensation may include providing an on-bias voltage or an off-bias voltage to a gate terminal of the drive transistor between the first frame and a subsequent, second frame to reset the threshold voltage of the drive transistor. More generally, after the first display frame, bias stress compensation voltages may be provided to the array of light-emitting diode display pixels to compensate for a bias stress effect in each pixel associated with at least the first display frame. However, applying the on-bias compensation voltage may cause the threshold voltage of the drive transistor to overshoot and decay during the subsequent second frame or applying the off-bias compensation voltage may cause the threshold voltage of the drive transistor to undershoot and decay during the subsequent second frame. As described in further detail hereinafter, the on-bias compensation voltage and the off-bias compensation voltage may be content-independent or content-dependent.

In order compensate for the overshoot or undershoot and decay of the threshold voltage in the drive transistor, at block 1504, a pulse-width-modulated (PWM) display current may be provided to the OLED of the pixel circuit after providing the bias stress and during the second frame. More generally, during a second display frame that follows the bias stress compensation, the array of light-emitting diode display pixels may be operated using pulse-width-modulated input signals to reduce a flicker generated by the bias stress compensation. Providing the PWM current may include providing a PWM input voltage (e.g., to a switching transistor of the pixel circuit) to modulate the display current through the drive transistor to the OLED. As described in further detail hereinafter, the pulse-width-modulation may be content-dependent or content-independent.

At block 1506, a length of the second display frame may optionally be adjusted based on a reduced flicker provided by the pulse-width-modulated current. For example, the length of the second display frame may be selected, during the second display frame, based on the content of the second display frame and based on a minimum available refresh rate determined based on a peak luminance of the second display frame. As indicated in FIG. 15, the operations of blocks 1500, 1502, 1504, and 1506 may be repeated during operation of the display with the second frame replacing the first frame and a subsequent (e.g., third, fourth, etc.) frame replacing the second frame. The operations of blocks 1500, 1502, 1504, and 1506 may also be performed, in parallel, in series, or a combination thereof for the other pixels of the pixel array.

Figure 16:
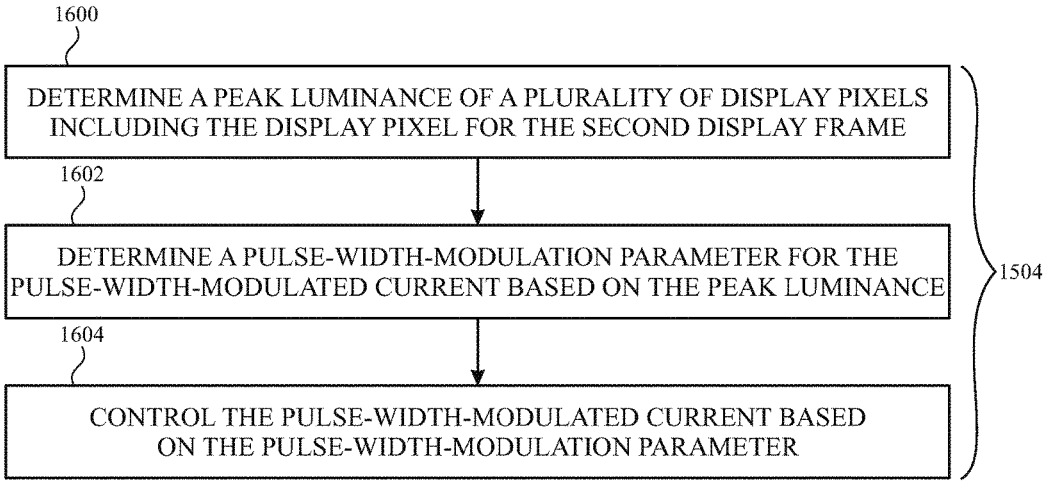
FIG. 16 illustrates a flow chart of an example process for providing a pulse-width-modulated current to an organic light emitting diode of a display pixel in accordance with various aspects of the subject technology.

Various operations that may be performed for providing the pulse-width-modulated (PWM) current to the OLED of the pixel circuit after providing the bias stress and during the second frame, as described above in connection with block 1504 of FIG. 15, are shown in the flow chart of FIG. 16, in accordance with various aspects of the subject disclosure.

At block 1600, a peak luminance of a plurality of display pixels, including the display pixel, may be determined for the second display frame. The peak luminance may be the luminance of a brightest pixel or a group of bright pixels in the second display frame, as described herein. The peak luminance may be determined from the display data to be displayed.

At block 1602, a pulse-width-modulation parameter for the pulse-width-modulated current may be determined based on the peak luminance (e.g., as described above in connection with FIGS. 11-15). For example, a minimum PWM ratio for the second frame may be determined based on the peak luminance or a series of PWM ratios or PWM percentages, each corresponding to a time interval within the second frame, may be obtained from a look-up table as described herein.

At block 1604, the pulse-width-modulated current may be controlled based on the pulse-width-modulation parameter. For example, the "on" pulse of the PWM current may be reduced (e.g., for on-bias compensation), or increased (e.g., for off-bias compensation), over the course of the second display frame based on the values within the lookup table for the determined peak luminance.

However, the operations described in connection with blocks 1600 and 1602 of FIG. 16, in which the pulse-width-modulation parameter is determined based on the peak luminance, are merely illustrative. In some scenarios, the pulse-width-modulation parameter and/or pulse-width-modulated current may be independent of the luminance of the second display frame (e.g., a common pulse-width-modulation may be applied to all display frames following bias stress compensation).

In order to facilitate operating the display with a pulse-width-modulated current that is independent of the luminance of the display frame, the bias stress compensation that is applied to the drive transistor (e.g., for on-bias or off-bias stress compensation) may be applied based on a luminance associated with the second frame. For example, the luminance associated with the second frame may be a peak luminance or average luminance as described herein. A data voltage or display voltage corresponding to the luminance associated with the second frame may be used as a reference voltage for an on-bias stress compensation or off-bias stress compensation (e.g., by applying a positive or negative fixed voltage shift relative to the display voltage).

Figure 17:
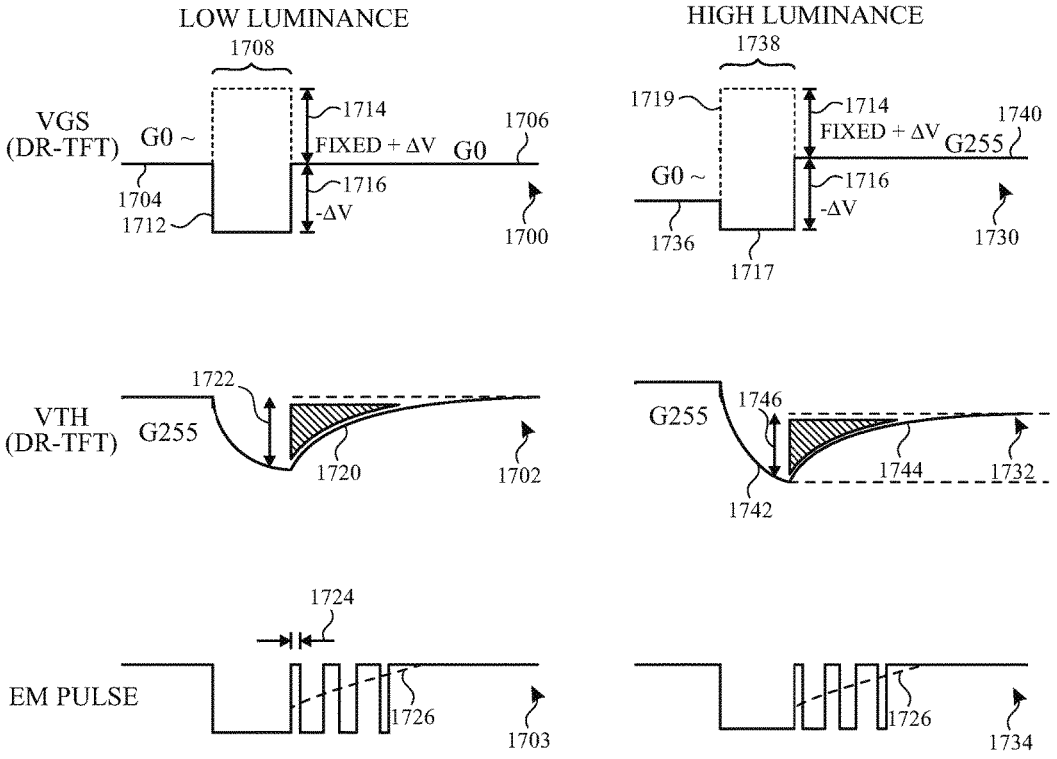
FIG. 17 illustrates a diagram of various pixel signal timelines during operation of a display pixel using a content-dependent bias compensation in accordance with various aspects of the subject technology.
Figure 18:
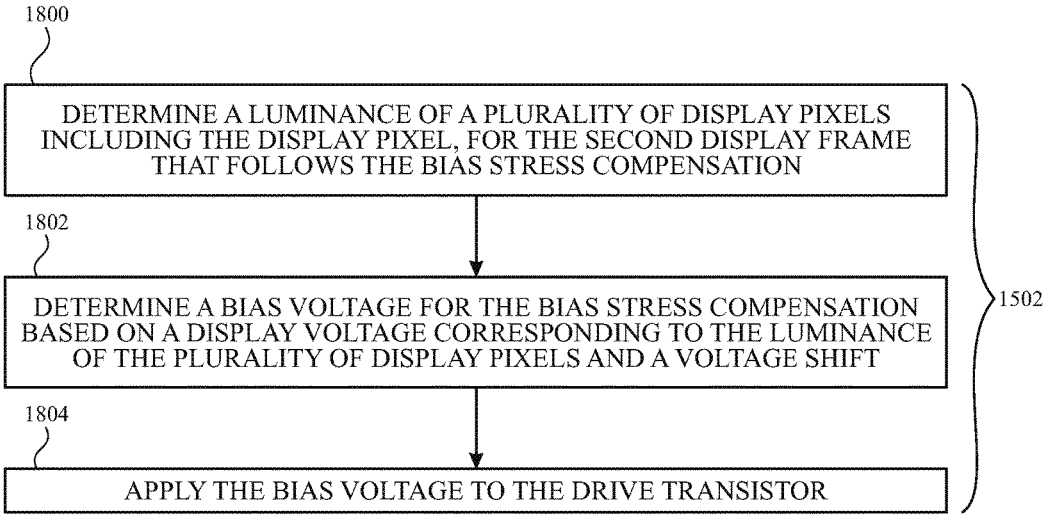
FIG. 18 illustrates a flow chart of an example process for providing a content-dependent bias compensation in accordance with various aspects of the subject technology.

FIG. 17 illustrates a gate voltage (VGS) timeline 1700, a resulting threshold voltage (Vth) timeline 1702, and pulse-width-modulation signal timeline 1703 for a low luminance second display frame and a gate voltage (VGS) timeline 1730, a resulting threshold voltage (Vth) timeline 1732, and pulse-width-modulation signal timeline 1734 for a relatively higher luminance second display frame. The gate voltage and threshold voltage timelines of FIG. 17 relate to the gate voltage and threshold voltage, respectively, of the drive transistor (Dr-TFT) of a pixel circuit.

In the example of FIG. 17, gate voltage timeline 1700 includes a first frame portion 1704, a second frame portion 1706, and a bias stress compensation portion 1708. The second frame portion 1706 corresponds to a second display frame that follows the bias stress compensation. An off-bias stress compensation pulse 1712 is shown (solid line) with an amplitude 1716 corresponding to a voltage shift, −ΔV, relative to the gate voltage corresponding to second frame portion 1706. For comparison, an on-bias stress compensation pulse 1710 is shown (dashed line) with an amplitude 1714 corresponding to a voltage shift, +ΔV, relative to the gate voltage corresponding to second frame portion 1706. The gate voltage illustrated by gate voltage time line 1700 may be a gate voltage (sometimes referred to as a data voltage or a display voltage) that corresponds to a peak luminance of the display frames or a gate voltage that corresponds to an average luminance of the display frames (as examples). As shown in FIG. 17, for low luminance gate voltage timeline 1700, the gate voltage in the second frame portion 1706 is relatively similar to (e.g., the same as) the gate voltage in the first frame portion 1704 and for high luminance gate voltage timeline 1730, the gate voltage in the second frame portion 1740 is relatively larger than the gate voltage in the first frame portion 1736.

Threshold voltage timeline 1702 resulting from the gate voltage of gate voltage timeline 1700 shows an off-bias undershoot portion 1718 and an increasing decay portion 1720 that, without compensation, may cause a visible display flicker. Pulse-width-modulation signal timeline 1703 shows an "on" pulse width 1724 that increases during the second display frame and that may be applied to compensate for the off-bias undershoot 1718 and increasing decay 1720.

Because the "on" portion of signal 1703 increases and the "off" portion of signal 1703 decreases (e.g., the PWM ratio increases) over the course of the second display frame, the time-averaged value of PWM signal 1703 increases over the course of the second display frame according to increasing decay curve 1726. PWM signal 1703 may represent the current provided to the OLED of a display pixel or may represent a control signal (e.g., an input voltage) that controls the provided current. Accordingly, the time averaged value of the current provided to the OLED of a display pixel may be increased according to increasing decay curve 1726 to compensate for a decrease in luminance caused by the increasing threshold voltage decay 1720.

As shown in FIG. 17, pulse-width-modulation signal timeline 1734 for a high luminance second frame applies a PWM that is the same as the PWM of pulse-width-modulation signal timeline 1703 for the low luminance second frame (e.g., having the same increasing decay curve 1726). The same increasing decay curve 1726 can be used, independent of the display frame luminance, because (as shown in gate voltage timeline 1730), the voltage shift, −ΔV or +ΔV, for the off-bias stress compensation pulse 1717 or on-bias stress compensation pulse 1719 respectively (during bias stress compensation portion 1738) is applied relative to the gate voltage of the second frame portion 1740. Accordingly, the resulting threshold voltage undershoot 1742 is followed by an increasing decay 1744 that has an amplitude 1746 that is the same as amplitude 1722 of increasing decay 1720.

Although the absolute threshold voltage is different in the low and high luminance scenarios, the increasing decay (which would be responsible for the visible display flicker if uncompensated) is the same in the low and high luminance scenarios, and the same PWM correction can thus be successfully applied to both low and high luminance frames.

Various operations that may be performed for providing a bias stress compensation, as described above in connection with block 1502 of FIG. 15, are shown in the flow chart of FIG. 16, in accordance with various aspects of the subject disclosure. In the example of FIG. 16, a content-based or content-dependent bias stress compensation is described in which bias stress compensation is based on a luminance associated with a second display frame that follows the bias stress compensation.

At block 1800, a luminance associated with a plurality of display pixels, including the display pixel, may be determined for the second display frame. The luminance associated with the plurality of display pixels may be a peak luminance, an average luminance, or a median luminance for the plurality of display pixels (as examples). The peak luminance may be the luminance of a brightest pixel or a group of bright pixels in the second display frame, as described herein. The luminance associated with the plurality of display pixels may be determined from the display data to be displayed in the second display frame.

At block 1802, a bias voltage for the bias stress compensation may be determined based on a display voltage corresponding to the luminance of the plurality of display pixels and a voltage shift. The display voltage may be a gate voltage corresponding to the luminance of the plurality of display pixels for the second frame as described above in connection with FIG. 17. The voltage shift may be a fixed voltage shift, such as voltage shift +ΔV (for on-bias stress compensation) or a voltage shift −ΔV (for off-bias stress compensation) as described above in connection with FIG. 17. The bias voltage may be a combination (e.g., a sum) of the gate voltage corresponding to the luminance of the second frame and the voltage shift. In some implementations, the display/gate voltage corresponding to the luminance may be determined directly, without determining the luminance itself.

At block 1804, the determined bias voltage may be applied to the drive transistor of the pixel circuit to provide the content-based bias compensation. Following application of the determined content-based bias voltage to the drive transistor of the pixel circuit, a content-independent PWM current may be provided to the light-emitting element of the pixel circuit as described above in connection with FIG. 1504. Of course, it should be appreciated that, in other operational scenarios, a content-independent bias stress compensation and content-dependent PWM signal may be used, a content-independent bias stress compensation and content-independent PWM signal may be used, or a content-dependent bias stress compensation and content-dependent PWM signal may be used.

Figure 19:
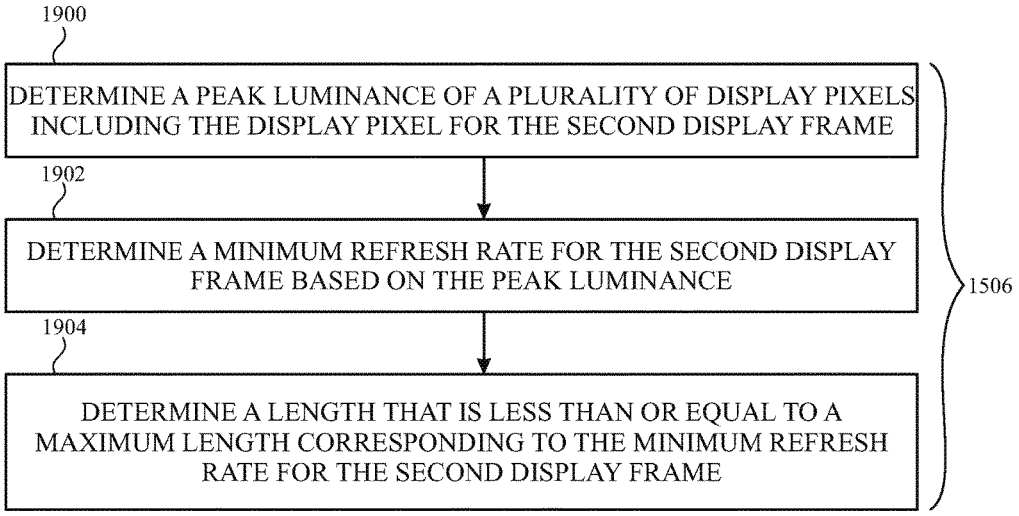
FIG. 19 illustrates a flow chart of an example process for dynamic refresh rate operation of an electronic device display in accordance with various aspects of the subject technology.

Various operations that may be performed for adjusting the length of the second display frame based on a reduced flicker provided by the pulse-width-modulated current, as described above in connection with block 1506 of FIG. 15, are shown in the flow chart of FIG. 19, in accordance with various aspects of the subject disclosure.

At block 1900, a peak luminance of a plurality of display pixels, including the display pixel, may be determined for the second display frame. The peak luminance may be the luminance of a brightest pixel or a group of bright pixels in the second display frame. The peak luminance may be determined from the display data to be displayed. The operations of block 1900 may be the same as the operations of block 1600 or block 1800, in some implementations.

At block 1902, a minimum refresh rate for the second display frame may be determined based on the peak luminance. For example, the minimum refresh rate may be a minimum available refresh rate that has been reduced due to the PWM flicker compensation, and that provides a lower limit for a dynamic refresh rate operation.

At block 1904, a length that is less than or equal to a maximum length corresponding to the minimum refresh rate for the second display frame may be determined. The length for the second display frame may be a maximum length that does not generate visible flicker. The maximum length may be larger for low peak luminance frames than for high peak luminance frames.

Although various examples of PWM compensation for pixel-level effects have been described herein in the context of on-bias stress compensation, the systems and method described herein may apply to other predicable pixel-level effects. In particular, any pixel-level effect that causes a predictable variation in pixel luminance over the course of one or more display frames can be compensated by pulse-width modulating the current to the OLED (e.g., on a pixel level, regional level or global level). Compensating for the predictable pixel-level effect may include (a) identifying the predictable luminance changes caused over time by the pixel-level effect, (b) determining a pulse-width ratio pattern that, when applied to the OLED, counteracts the identified luminance changes, (c) storing, with display control circuitry or system circuitry, the determined pulse-width ratio pattern (e.g., in a look-up table), and (d) operating the pixels using the determined pulse-width ratio pattern (e.g., by providing a display current to the OLED, modulated according to the pulse-width ratio pattern).

Although examples of decaying pulse-width ratio patterns have been described in the context of on-bias stress compensation, this is merely illustrative. In other implementations, PWM compensation may be provided with an increasing pulse-width ratio pattern or a more complex increasing and decreasing or non-periodic pulse-width ratio pattern.

Although various examples of PWM compensation for pixel-level effects have been described herein in the context of organic light-emitting diode display pixels, this is merely illustrative. In various implementations, PWM control of the light-emitting elements or light-control elements of displays based on other technologies, using the methods described herein to compensate for predictable pixel-level behaviors, may provide similar flicker-reduction and power-saving benefits (e.g., by modulating the backlight and/or the liquid crystal elements of the pixels).

In accordance with various aspects of the subject disclosure, a method is provided that includes operating, during a first display frame, a drive transistor of a pixel circuit of an electronic device display to provide a first current to a light-emitting element of the pixel circuit. The method may also include providing, after the first display frame, an on-bias stress compensation to the drive transistor. The method may also include providing, after providing the on-bias stress compensation and during a second display frame, a pulse-width-modulated current to the light-emitting element of the pixel circuit.

In accordance with other aspects of the subject disclosure, an electronic device having a display with an array of display pixels each having a drive transistor and a light-emitting diode coupled to the drive transistor is provided, the electronic device including display control circuitry. The display control circuitry may be configured to operate, during a first display frame, the drive transistors of the array of display pixels to provide display currents to the light-emitting diodes of the array of display pixels. The display control circuitry may also be configured to provide, after the first display frame, on-bias stress compensation voltages to the drive transistors of the array of display pixels. The display control circuitry may also be configured to provide, after providing the on-bias stress compensation voltages and during a second display frame, pulse-width-modulated currents to the light-emitting diodes of the array of display pixels.

In accordance with other aspects of the subject disclosure, an electronic device having a display with an array of display pixels is provided, the electronic device including display control circuitry. The display control circuitry may be configured to provide, following a first display frame, an on-bias stress compensation to the array of display pixels to compensate for a bias stress effect associated with at least the first display frame. The display control circuitry may also be configured to operate, during a second display frame that follows the on-bias stress compensation, the array of display pixels using pulse-width-modulated input signals to reduce a flicker generated by the on-bias stress compensation.

In accordance with other aspects of the subject disclosure, an electronic device having a display with an array of display pixels is provided, the electronic device including display control circuitry configured to provide, following a first display frame, a bias stress compensation to the array of display pixels to compensate for a bias stress effect associated with at least the first display frame, where bias stress compensation is based on a luminance associated with a second display frame that follows the bias stress compensation. The display control circuitry is further configured to operate, during the second display frame that follows the bias stress compensation, the array of display pixels using pulse-width-modulated input signals to reduce a flicker generated by the bias stress compensation.

Various functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "processor", and "memory" all refer to electronic or other technological devices. These terms exclude people or groups of people. For the purposes of the specification, the terms "display" or "displaying" means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

To provide for interaction with a user, implementations of the subject matter described in this specification can be implemented on a computer having a display device as described herein for displaying information to the user and a keyboard and a pointing device, such as a mouse or a trackball, by which the user can provide input to the computer. Other kinds of devices can be used to provide for interaction with a user as well; for example, feedback provided to the user can be any form of sensory feedback, such as visual feedback, auditory feedback, or tactile feedback; and input from the user can be received in any form, including acoustic, speech, or tactile input.

Many of the above-described features and applications are implemented as software processes that are specified as a set of instructions recorded on a computer readable storage medium (also referred to as computer readable medium). When these instructions are executed by one or more processing unit(s) (e.g., one or more processors, cores of processors, or other processing units), they cause the processing unit(s) to perform the actions indicated in the instructions. Examples of computer readable media include, but are not limited to, CD-ROMs, flash drives, RAM chips, hard drives, EPROMs, etc. The computer readable media does not include carrier waves and electronic signals passing wirelessly or over wired connections.

In this specification, the term "software" is meant to include firmware residing in read-only memory or applications stored in magnetic storage, which can be read into memory for processing by a processor. Also, in some implementations, multiple software aspects of the subject disclosure can be implemented as sub-parts of a larger program while remaining distinct software aspects of the subject disclosure. In some implementations, multiple software aspects can also be implemented as separate programs. Finally, any combination of separate programs that together implement a software aspect described here is within the scope of the subject disclosure. In some implementations, the software programs, when installed to operate on one or more electronic systems, define one or more specific machine implementations that execute and perform the operations of the software programs.

A computer program (also known as a program, software, software application, script, or code) can be written in any form of programming language, including compiled or interpreted languages, declarative or procedural languages, and it can be deployed in any form, including as a stand alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

It is understood that any specific order or hierarchy of blocks in the processes disclosed is an illustration of example approaches. Based upon design preferences, it is understood that the specific order or hierarchy of blocks in the processes may be rearranged, or that all illustrated blocks be performed. Some of the blocks may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

The predicate words "configured to", "operable to", and "programmed to" do not imply any particular tangible or intangible modification of a subject, but, rather, are intended to be used interchangeably. For example, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "example" is used herein to mean "serving as an example or illustration." Any aspect or design described herein as "example" is not necessarily to be construed as preferred or advantageous over other aspects or design.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. A method, comprising:

operating, during a first display frame, a drive transistor of a pixel circuit of an electronic device display to provide a first current to a light-emitting element of the pixel circuit;

providing, after the first display frame, a bias stress compensation to the drive transistor; and providing, after providing the bias stress compensation and during a second display frame, a pulse-width-modulated current to the light-emitting element of the pixel circuit by compensating for an overshoot and decay of a threshold voltage of the drive transistor caused by provided on-bias stress.

2. The method of claim 1, wherein providing the bias stress compensation comprises providing an on-bias stress compensation to the drive transistor that resets a threshold voltage of the drive transistor to compensate for a bias stress effect in the drive transistor, the bias stress effect associated with at least the first display frame.

3. The method of claim 1, wherein providing the pulse-width-modulated current to the light-emitting element of the pixel circuit reduces display flicker for the electronic device display.

4. The method of claim 1, wherein providing the pulse-width-modulated current comprises modulating a second current to the light-emitting element with a pulse-width-modulation ratio that decays during the second display frame.

5. The method of claim 4, wherein the pulse-width-modulation ratio decays at a decay rate that corresponds to a rate of the decay of the threshold voltage.

6. The method of claim 5, further comprising, determining the decay rate based on a peak luminance across a plurality of display pixels of the electronic device display for the second display frame.

7. The method of claim 6, further comprising determining a minimum available refresh rate for the second display frame based on the peak luminance.

8. The method of claim 6, wherein the light-emitting element comprises an organic light-emitting diode, wherein the electronic device display is an organic light-emitting diode display that comprises an array of active organic light-emitting diode display pixels, and wherein the plurality of display pixels comprises all of the active organic light-emitting diode display pixels.

9. The method of claim 6, wherein the light-emitting element comprises an organic light-emitting diode, wherein the electronic device display is an organic light-emitting diode display that comprises an array of active organic light-emitting diode display pixels, and wherein the plurality of display pixels comprises a subset of the active organic light-emitting diode display pixels.

10. The method of claim 6, wherein the light-emitting element comprises an organic light-emitting diode, wherein the electronic device display is an organic light-emitting diode display that comprises an array of active organic light-emitting diode display pixels, and wherein the method further comprises:

providing, to each of the active organic light-emitting diode display pixels, a pulse-width-modulated input voltage with the decay rate based on the peak luminance.

11. An electronic device having a display with an array of display pixels each having a drive transistor and a light-emitting diode coupled to the drive transistor, the electronic device comprising:

display control circuitry configured to:

operate, during a first display frame, the drive transistors of the array of display pixels to provide display currents to the light-emitting diodes of the array of display pixels;

provide, after the first display frame, bias stress compensation voltages to the drive transistors of the array of display pixels; and provide, after providing the bias stress compensation voltages and during a second display frame, pulse-width-modulated currents to the light-emitting diodes of the array of display pixels by compensating for an overshoot and decay of a threshold voltage of the drive transistor caused by provided on-bias stress.

12. The electronic device of claim 11, wherein the light-emitting diodes comprise organic light-emitting diodes, and wherein the display control circuitry is further configured to adjust a length of the second display frame based, at least in part, on a reduced flicker provided by the pulse-width-modulated currents.

13. The electronic device of claim 12, wherein the display control circuitry is configured to adjust the length of the second display frame based on a peak luminance across the array of display pixels for the second display frame.

14. The electronic device of claim 11, wherein the display control circuitry is configured to provide the pulse-width-modulated currents to the light-emitting diodes of the array of display pixels based on a peak luminance, over the array of display pixels, for the second display frame.

15. The electronic device of claim 11, wherein the display control circuitry is configured to provide the pulse-width-modulated currents to the light-emitting diodes of the array of display pixels by modulating a pixel-specific display current for each display pixel with a global pulse-width modulation.

16. The electronic device of claim 11, wherein the display control circuitry is configured to provide the pulse-width-modulated currents to the light-emitting diodes of the array of display pixels by modulating a pixel-specific display current for each display pixel with a regional pulse-width modulation that is specific to a region of the array of display pixels.

17. The electronic device of claim 11, wherein the display control circuitry is configured to provide the pulse-width-modulated currents to the light-emitting diodes of the array of display pixels by modulating a pixel-specific display current for each display pixel with a pixel-specific pulse-width modulation.

18. An electronic device having a display with an array of display pixels, the electronic device comprising:

display control circuitry configured to:

provide, following a first display frame, a bias stress compensation to the array of display pixels to compensate for a bias stress effect associated with at least the first display frame; and operate, during a second display frame that follows the bias stress compensation, the array of display pixels to provide pulse-width-modulated input signals to reduce a flicker generated by the bias stress compensation by compensating for an overshoot and decay of a threshold voltage of a drive transistor caused by provided on-bias stress.

19. The electronic device of claim 18, wherein the array of display pixels comprises an array of organic light-emitting diode display pixels, wherein the pulse-width-modulated input signals have a common pulse-width ratio, and wherein the display control circuitry is configured to reduce the pulse-width ratio during progression of the second display frame.

20. The electronic device of claim 19, wherein the display control circuitry is configured to reduce the pulse-width ratio based on a peak luminance, across the array of display pixels, for the second display frame.

21. The electronic device of claim 19, wherein the bias stress compensation is an on-bias stress compensation.

22. The electronic device of claim 18, wherein the bias stress compensation is an off-bias stress compensation, wherein the pulse-width-modulated input signals have a common pulse-width ratio, and wherein the display control circuitry is configured to increase to the pulse-width ratio during progression of the second display frame.

23. The electronic device of claim 18, wherein the display control circuitry is further configured to determine a decay rate for the pulse-width-modulated input signals based on a peak luminance over the array of display pixels for the second display frame.

24. An electronic device having a display with an array of display pixels, the electronic device comprising:

display control circuitry configured to:

provide, following a first display frame, a bias stress compensation to the array of display pixels to compensate for a bias stress effect associated with at least the first display frame, wherein the bias stress compensation is based on a luminance associated with a second display frame that follows the bias stress compensation; and operate, during the second display frame that follows the bias stress compensation, the array of display pixels to provide pulse-width-modulated input signals to reduce a flicker generated by the bias stress compensation by compensating for an overshoot and decay of a threshold voltage of a drive transistor caused by provided on-bias stress.

25. The electronic device of claim 24, wherein the pulse-width-modulated input signals are independent of the luminance associated with the second display frame.

26. The electronic device of claim 24, wherein the luminance associated with the second display frame is a peak luminance of the second display frame.

27. The electronic device of claim 24, wherein the luminance associated with the second display frame is an average luminance of the second display frame.

28. The electronic device of claim 24, wherein the bias stress compensation comprises an application of a bias voltage to a drive transistor of each display pixel of the array of display pixels, and wherein the bias voltage comprises a voltage shift relative to a display voltage corresponding to the luminance associated with the second display frame.

* * * * *